United States Patent [19]

Schirneker

[11] Patent Number: 4,685,397

[45] Date of Patent: Aug. 11, 1987

[54] LEAD-FREE BULLET FOR HUNTING

[76] Inventor: Hans-Ludwig Schirneker, Engelslit 10, D-4773 Möhnesee-Völlinghausen, Fed. Rep. of Germany

[21] Appl. No.: 839,117

[22] Filed: Mar. 12, 1986

[30] Foreign Application Priority Data

Mar. 22, 1985 [DE] Fed. Rep. of Germany ..... 3510343

[51] Int. Cl.[4] ..... F42B 11/10

[52] U.S. Cl. ..... 102/510; 102/501; 102/517

[58] Field of Search ..... 102/501, 507–510, 102/514–519

[56] References Cited

U.S. PATENT DOCUMENTS 854,923 5/1907 Broad ..... 102/508
1,134,797 4/1915 Wood ..... 102/508
4,136,616 1/1979 Schirneker ..... 102/510

FOREIGN PATENT DOCUMENTS 15574 9/1983 European Pat. Off. .
2843167 4/1980 Fed. Rep. of Germany ..... 102/510

*Primary Examiner*—Harold J. Tudor
*Attorney, Agent, or Firm*—Schweitzer & Cornman

[57] ABSTRACT

There is disclosed a lead-free and plastics-free hunting bullet, preferably made of tombac, in which on impact with a target a cap, which is provided with wedge-shaped projections, is forced rapidly rearwards within the bullet so that the projections rupture the wall of the bullet internally with the results that uniformly distributed tongues or petals are formed within the target. The bullet maintains its overall weight on passage through the body of an animal and no lead or plastics material can be become transferred to the body.

6 Claims, 4 Drawing Figures

LEAD-FREE BULLET FOR HUNTING

Figure 1:
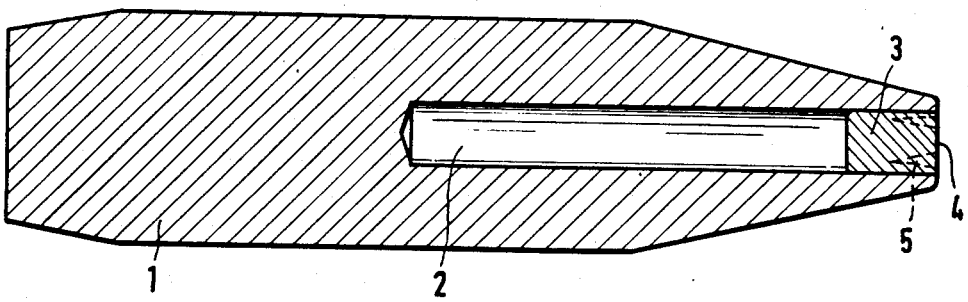

This invention aims to protect a lead-free bullet for hunting in which, on impact with the body of an animal, preferential rupturing points are imposed on the bullet by means of the closure cap so that the bullet is spread into equal parts and no loss of weight of the shot occurs as it passes through the body.

Bullets are known for hunting, comprising an outer mantle and a lead core. The nose may be solid or of hollow shape. The mantle may incorporate reinforcements extending around the bullet to limit the degree of mushrooming.

On passage through the target these bullets produce a lot of splinters from the mantle or jacket and from the lead, and the lead is broken down into a fine powder or smeared deposit. As a result of this the bullet loses a large part of its original weight so that in many cases the energy in the bullet is no longer sufficient to achieve the desired effect. If the animal still escapes and survives until a later time, at least part of the lead deposit passes into the bloodstream of the animal.

Hunting bullets are also known, comprising a massive body of tombac (a copper-zinc alloy rich in copper) and having a blind hole extending in from the nose. Preferential rupture points are provided within the bore of the blind hole. The hole itself is filled with lead or plastics material. This bullet, with a lead filling, exhibits a particularly marked degree of lead smearing and when it is filled with plastics material there is complete attrition of the plastics.

Bullets for hunting are also known comprising a massive body of tombac and in which the blind hole is closed off at its front end by a cap. Grooves or splines are provided in the external surface of the nose, so as to achieve uniform spread of the bullet. These grooves, however, offer an increased air resistance to the air in flight so that the projectile loses velocity, and therefore energy, more rapidly. Also such bullets are relatively expensive to manufacture, because of the need to form the grooves.

The object of the invention is to eliminate the abovementioned drawbacks. The invention envisages a bullet in which the entire body is made, for example, of tombac. The body of the shot is made with a sharp (e.g. conical) nose in a known manner. In the centre of the bullet, starting from the nose, there is a blind hole which is closed by a special form of cap, preferably made of steel. The cap has two or more (preferably four or five) projections or ribs which have the function, on impact with the target and on displacement of the cap rearwards into the hole, of cutting into the inside wall of the hole in order to achieve a uniform spread. Preferably the closure cap is not domed at its front end but made flat or hollow. This results in a reliable and rapid rearward movement of the cap.

On impact of such a bullet with the body of a wild animal the cap is displaced rearwards into the bore of the hole, the projections on the cap forcibly grooving the wall of the bore. In the cavity presented in front of the cap there now arises a high ram pressure by which the nose of the bullet is spread or torn apart to form an array of outwardly splayed tongues or petals. The points of rupture are distributed uniformly around the periphery of the bullet at the points where the grooves have been formed by the projections on the cap. The further the cap penetrates rearwards, the more are the torn tongues or petals of the body of the bullet enlarged and they fold back to the rear in a ring as a result of the resistance offered by the target as the bullet moves through it. As the shot has spread out symmetrically in the process it maintains its direction within the body of the target and does not tumble. By virtue of the low weight of the cap and the minimum resistance to be overcome in its rearward movement, it reacts very quickly so that the spreading takes place immediately on impact with the target and is propagated rapidly. On the passage of the bullet through the body of the animal, no metal particles are separated from the bullet and so it maintains its full mass. This ensures that almost every time a full penetration is achieved. By the rotation of the shot in the body of the target and as a consequence of the projecting tongues, a particularly large number of blood vessels is destroyed, which is important in order to achieve sufficient yield of fluid on emergence of the missile from the body.

Because there is no splintering, such as arises with a jacketed bullet having a lead core, the damage to the flesh is only very minimal.

Naturally it is also possible to arrange the projections on the cap somewhat inclined to its axis. This achieves a screw-like grooving process, rather like rifling, so that the tongues which it forms in the bullet also extend correspondingly in directions inclined to the axis. The inclined formation of the tongues can result in an enhanced effect. The projections can, if desired, be inclined in two directions so that, with reference to the positions of the preferential rupture lines, either of a left hand or a right hand twist occurs. The bullet can also be provided with a sharp cutting edge.

Bullets made of solid tombac generally have an increased resistance to insertion in the barrel. This effect can be counteracted if relief grooves or a cone are provided on the rear end of the guiding portion of the bullet. It is also possible to make the bore of the blind hole not cylindrical but slightly conical or to make part of it conical. In this way the spread of the bullet can be controlled.

The bullet according to the invention is easy to manufacture on automatic lathes. The cap is manufactured simply by a cold pressing method preferably from steel. The cap only then needs to be pressed into the nose of the bullet. The presence of the projections on the cap ensures a secure seating.

Figure 2:
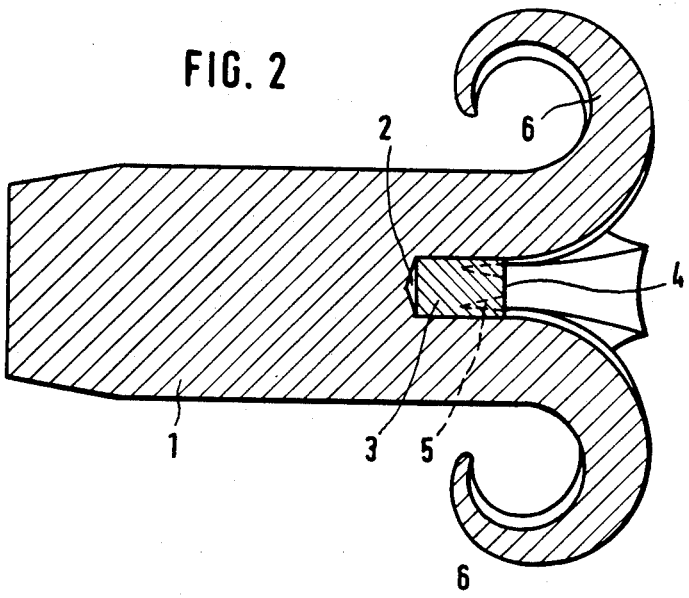
Figure 3:
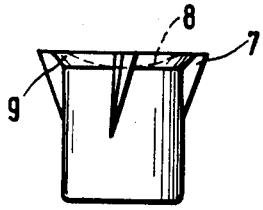
Figure 4:
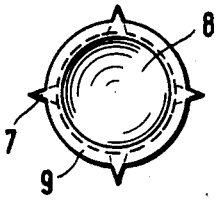

An embodiment of the lead-free hunting bullet according to the invention and a cap to a larger scale are illustrated by way of example in the drawings, in which:

FIG. 1 is a longitudinal section through one embodiment of the bullet with a cap having rib-like projections extending parallel to the axis, FIG. 2 is a longitudinal section through the bullet of FIG. 1 after impact, FIG. 3 is a longitudinal section through an embodiment of the cap which has projections extending in directions inclined to the axis, FIG. 4 is an end view of a cap shown in FIG. 3.

The body of the bullet illustrated in FIG. 1 is made, for example, of tombac, copper or the like. A blind hole 2 is placed centrally at the front end of the body 1. Inserted in the nose is a cap 3 of which the end face 4 is made flat. Arranged on the external surface of the cap 3 there are rib-like projections 5 of wedge-shaped cross-section. The cap 3 is pressed permanently into the nose of the body 1.

FIG. 2 shows a longitudinal section through a bullet after it has been fired and in the spread condition after impact with a target. The nose and the first part of the cylindrical body 1 of the bullet have been deformed to form laterally projecting tongues or petals 6 by the cap 3, which has been displaced to the rear end of the hole 2.

FIGS. 3 and 4 illustrate a cap provided with rib-like projections 7 which extend in directions inclined to the axis. The face of the cap is made concave towards the front and is provided with a diverging edge 9.

The lead-free hunting bullet described above fulfils all the internal and external and target-ballistic requirements. It reacts very rapidly on impact with the target, maintains its direction within the body of the target and achieves a sufficiently large penetration and exit, the destruction of the flesh of the beast is only minimal, the yield of energy to the target is good and thereby also the effect, and finally it is a bullet which is completely free of lead and of plastics material so that poisoning cannot occur.

What is claimed is:

1. An improved two-piece, mushrooming petal bullet for use in hunting, consisting of (1)

(a) a solid shot body made of tombac, or copper having a forwardmost nose portion and a horizontal axis;

(b) said nose portion including a cylindrical internal wall forming a blind passage extending rearwardly within said body along said axis and including an internal wall, said passage having a uniform diameter and being substantially cylindrical over its entire length free of prefabricated notches or grooves; and (2)

(a) a solid body cap having a generally cylindrical shape for substantially its entire length; said cap body having an outer diameter substantially equal to the diameter of said cylindrical passage; said cap body being force fitted into and closing the open end of said passage;

(b) a conical portion formed in the forwardmost portion of said cap body and flaring outwardly from said cap body;

(c) at least two lateral projections of wedgeshaped cross section defined by the external surface of said cap body and extending rearwardly from said conical portion to said cylindrical portion; and (d) said cylindrical cap body being of length substantially less than the length of said passage and being rearwardly displaceable within said cylindrical passage upon impact with a target, thereby causing said projections to score said internal wall to form preferential rupture lines, whereby said nose portion ruptures along said lines and to spread laterally to form petals.

2. The mushrooming petal bullet set forth in claim 1, wherein said projections on said cylindrical cap body are in the form of ribs extending parallel to said axis of said shot body.

3. The mushrooming petal bullet set forth in claim 1, wherein said projections on said cylindrical cap body are in the form of ribs extending at an angle with respect to said axis of said shot body.

4. The mushrooming petal bullet set forth in claim 1, wherein said projections are spaced equidistantly around said cylindrical cap body.

5. The mushrooming petal bullet set forth in claim 1, wherein said cap body is formed of steel and has a flat front face.

6. The mushrooming petal bullet set forth in claim 1, wherein said cap body is formed of steel and has a concave front face.

* * * * *